US006462011B1

(12) United States Patent
Collins et al.

(10) Patent No.: US 6,462,011 B1
(45) Date of Patent: Oct. 8, 2002

(54) METHOD OF AND COMPOSITION FOR TREATING HYDROCARBON BASED MATERIALS

(75) Inventors: Bevan C. Collins, Bartlesville, OK (US); Larry D. Martin, Duncan, OK (US)

(73) Assignee: United Laboratories International, LLC, Duncan, OK (US)

( * ) Notice: Subject to any disclaimer, the term of this patent is extended or adjusted under 35 U.S.C. 154(b) by 0 days.

(21) Appl. No.: 09/491,317

(22) Filed: Jan. 25, 2000

Related U.S. Application Data

(63) Continuation-in-part of application No. 09/294,734, filed on Apr. 19, 1999, now abandoned.

(51) Int. Cl.[7] ..... C11D 3/20; C11D 3/382; C11D 7/44

(52) U.S. Cl. ..... 510/437; 510/188; 510/202; 510/213; 510/259; 510/267; 510/364; 510/365; 510/421; 510/433; 510/463; 510/475; 510/503; 510/504

(58) Field of Search ..... 510/188, 202, 510/213, 259, 267, 364, 365, 421, 433, 437, 463, 475, 503, 504

(56) References Cited

U.S. PATENT DOCUMENTS

| | | | | | |
|---|---|---|---|---|---|
| 5,356,482 | A | | 10/1994 | Mehta et al. | 134/22.1 |
| 5,389,156 | A | | 2/1995 | Mehta et al. | 134/10 |
| 5,391,325 | A | * | 2/1995 | Swenson et al. | 252/547 |
| 5,425,814 | A | | 6/1995 | Krajicek et al. | 134/22.1 |
| 5,807,476 | A | | 9/1998 | Collins et al. | 208/236 |
| 5,863,881 | A | * | 1/1999 | Vlasblom | 510/365 |
| 5,863,884 | A | * | 1/1999 | Lafreniere | 510/412 |
| 6,090,769 | A | * | 7/2000 | Vlasblom | 510/365 |
| 6,281,189 | B1 | * | 8/2001 | Heimann et al. | 510/491 |

OTHER PUBLICATIONS

AG Environmental Products, "Soygold 2000 Material Safety Data Sheet", Jul. 1, 1998.*

Soygold Solvents AG Environmental Products, 1 page, No date given.

Soygold Soybean Oil Methyl Esters AG Environmental Products, 1 page, No date given.

Soygold Code of Federal Regulations, Food and Drugs Title 21 AG Environmental Products, Apr. 1, 1995, 4 pages.

Soygold 1000 Industrial Solvent AG Environmental Products 2 pages, No date given.

Soygold 1000 Solvent Material Safety Data Sheet AG Environmental Products, Jul. 1, 1998, 3 pages.

Soygold 1000 Comparison of Solvent Properties AG Environmental Products no date given, 1 page.

Soygold 1000 Technical Data Sheet no author listed no date given, 1 page.

Soygold 1100 Industrial solvent, AG Environmental Products, No date given, 1 page.

Soygold 1100 Technical Data Sheet, no author listed, no date given, 1 page.

Soygold 1100 Material Safety Data Sheet, AG Environmental Products, Oct. 1, 1994, 3 pages.

Soygold 2000 Water Rinsable Industrial Solvent AG Environmental Product, no date given 1 page.

Soygold 2000 Material Safety Data Sheet, AG Environmental Products Jul. 1, 1998, 3 pages.

Tomah Ether Amine Oxide, Tomah Products, Inc., No date given, 1 page.

* cited by examiner

*Primary Examiner*—Yogendra N. Gupta
*Assistant Examiner*—Brian P. Mruk
(74) *Attorney, Agent, or Firm*—Thomas R. Weaver

(57) ABSTRACT

This application discloses a composition for and a method of using the composition to disperse hydrocarbon based components into a liquid carrier. The composition is comprised of a lower alkyl ester of a fixed oil, such as a modified vegetable oil, in combination with at least one other compound which enhances the ability of the ester to form an aqueous emulsion which can separate and which can alter the wetting character of the ester. The method comprises contacting a material comprised of hydrocarbon based components with an effective amount of composition for a time and a temperature sufficient to disperse the material into a liquid carrier.

3 Claims, No Drawings

METHOD OF AND COMPOSITION FOR TREATING HYDROCARBON BASED MATERIALS

This is a continuation-in-part of application serial number 09/294,734 filed Apr. 19, 1999, now abandoned.

BACKGROUND OF THE INVENTION

1. Technical Field of the Invention

This invention relates to compositions for and methods of treating materials containing components which can be dispersed upon being contacted with an oil. This invention further relates to dispersing materials comprised of hydrocarbons and hydrocarbon residues by contacting the materials with a composition containing at least one ester of a fixed oil. This invention still further relates to removing solid deposits comprised of or derived from petroleum base components from a surface by contacting the deposits with a composition which contains a modified vegetable oil comprised of esters of fatty acids.

2. Description of the Prior Art and Problems Solved

It is known that materials containing hydrocarbons can be dispersed by contacting the materials with a wide variety of liquid cleaning formulations comprised of liquid hydrocarbons derived from petroleum. Such liquid hydrocarbons have been variously referred to in the chemical cleaning art as extractants, dispersants and solvents. The liquid cleaning formulations have ranged from substantially 100 percent oil formulations to combinations of oil and water including oil external/aqueous internal emulsions and aqueous external/oil internal emulsions. Accordingly, methods are known in the art for removing materials comprised of hydrocarbon oil, bitumens, asphalts, tar, hydrocarbon residues and similar petroleum based materials from a surface to which they adhere by contacting the materials with a cleaning formulation which includes a liquid hydrocarbon solvent, dispersant or extractant.

For purposes of this invention the phrase hydrocarbon components shall mean hydrocarbon oil, paraffins, bitumens, asphalts, tar, hydrocarbon residues and other petroleum based materials. The hydrocarbon components to be treated in accordance with the methods of this invention can occur in the liquid phase, the solid phase or some mixture of liquid and solid and ordinarily adhere to a substrate surface, such as metal, stone, concrete or paint, from which the hydrocarbon component is to be removed. Accordingly, the hydrocarbon components are variously referred to herein, and in the art, as deposits, contaminants, adherents and foulants.

The removal of deposits containing hydrocarbon components from a surface, such as a metal surface, is disclosed in U.S. Pat. Nos. 5,356,482, 5,389,156 and 5,425,814. Each of these patents disclose methods of and compositions for cleaning vessels employed in the refining and chemical processing of hydrocarbon feedstocks, such as crude petroleum oil. These patents discuss methods employed in the prior art to remove deposits from metal surfaces wherein the methods feature the use of conventional light hydrocarbon solvents in separate and successive deposit contacting steps and degassing steps. The steps are employed to remove deposits from the interiors of vessels and to enable workers to safely enter the vessels for inspection and internal mechanical repairs thereof.

With the prior art background in mind, the mentioned patents disclose a "unitary process" of simultaneous deposit removal and degassing featuring the use of terpenes, a specific class of hydrocarbon found in resins and volatile oils, which are also called "essential" oils. The patents are specifically concerned with a specific terpene, d-limonene, which naturally occurs in lemon peel, orange oil and pine needles. The patents disclose that d-limonene not only removes the usual hydrocarbon components, but also removes dangerous volatile organic contamination as well as benzene, which the patents disclose as being a known health hazard.

For purposes of definition, it is noted that an "essential oil" is any of a class of volatile, water insoluble oil that imparts the characteristic odors to plants. Essential oils are used in perfumes and flavorings. In contrast, a "fixed oil" is a nonvolatile, water insoluble oil, especially a fatty oil, such as vegetable oil.

In accordance with the above known methods, the deposits comprised of hydrocarbon components are contacted by the cleaning formulations for a time and at a temperature sufficient to cause the mentioned hydrocarbon components of the deposits to soften, disperse or dissolve to thereby enable removal of the deposits by liquid flushing, circulation, mechanical action or some combination thereof.

The cleaning formulations used in the known methods include hydrocarbons such as light cycle oil, heavy gas oil, diesel oil, kerosene and terpenes, such as d-limonene.

Petroleum hydrocarbon chemical solvents currently employed in prior art cleaning formulations, while performing satisfactorily from a cleaning point of view, contain compounds, broadly referred to herein as "problem compounds," which render use of the prior art solvents unsatisfactory from an environmental and personal health point of view. The problem compounds include volatile organic compounds, called VOCS, as well as other toxic and potentially carcinogenic materials, such as, benzene and methyl tertiary butyl ether. These problem compounds are known to cause eye and skin irritation and to be a source of water pollution. Furthermore, the problem compounds are not biodegradable.

Some cleaning methods involve treating the interiors of large vessels with a chemical cleaning formulation followed by entry of personnel into the treated interiors. It is, accordingly, clear that the use of the prior art petroleum solvents to clean such vessels, followed by personnel entry into the interiors thereof, requires extensive and time-consuming, post-cleaning operations, such as water flushing and steaming, to remove the problem compounds from the vessel interiors.

In view of the above, it is highly desirable, from an operational point of view, to employ a cleaning composition which will satisfactorily remove hydrocarbon components from a surface; which does not include volatile organic compounds, or other toxic and potentially carcinogenic materials, such as, benzene; which does exhibit sufficiently high flash and flame points to minimize explosion and fire hazards encountered during cleaning operations; which, because of its chemical nature, is biodegradable; which has a low chemical and biological oxygen demand; which will not be a source of environmental damage; and which will not present waste disposal problems.

In addition to the above, a desirable result of a chemical cleaning service is the absence of an oil film on the surface cleaned, such as a metal surface, at the conclusion of the cleaning process. It is thought that an oil-wet surface merely attracts and traps air-borne particles which serve to soil an otherwise clean surface. Accordingly, still another desirable feature of a cleaning composition employed to remove hydrocarbon components from a surface is that the composition operate to provide a cleaned surface that is water-wet and not oil-wet.

Furthermore, it is also desirable that the process of removing deposits comprised of hydrocarbon components from a surface be conducted by contacting the deposits with a relatively low concentration of chemical cleaning composition wherein the contact can be effectively conducted by use of an aqueous carrier. It is still further desirable to enable separation of the used cleaning composition, the removed hydrocarbon components and the aqueous carrier to facilitate disposal subsequent to the conclusion of the cleaning process.

These desirable features and other benefits are provided by the method and composition of this invention.

DISCLOSURE OF INVENTION

1. Summary of the Invention

It has now been discovered that a composition comprised of an ester of at least one fixed oil, together with one or more other compounds is useful to remove deposits comprised of hydrocarbon components from a surface while avoiding the formation of an oily film or residue on the surface contacted by the composition. This invention, accordingly, provides methods of and compositions for removing deposits comprised of hydrocarbon components from a surface while avoiding the formation of an oily film or residue on the surface contacted by the composition.

The composition is a liquid which not only operates to remove deposits comprised of hydrocarbon components from a surface, but which also can form an aqueous external emulsion which is useful to place the composition in contact with the deposits to be removed. In addition, the emulsion, upon setting, separates into an oil phase and a water phase to help facilitate further treatment of the removed hydrocarbon and disposal or reuse of the aqueous phase. Still further, the surface subsequent to treatment with the composition is water-wet.

In one aspect the liquid composition is a combination of a first component comprised of at least one ester of an unsaturated, long-chain fatty acid and a second component comprised of one or more compounds selected from ethoxylated alkyl phenols, fatty acid aliphatic quaternary ammonium compounds, fatty acid heterocyclic quaternary ammonium compounds, glycols and amine oxides. The liquid composition is uniform in appearance and can be a true solution or an oil external/aqueous internal microemulsion.

In another aspect, this invention provides an aqueous external/oil internal emulsion wherein the liquid composition of this invention is the internal phase of the emulsion.

In still another aspect, this invention provides a method of dispersing a material comprised of hydrocarbon components into a liquid carrier, comprising contacting the material with an emulsion consisting of an aqueous external phase and the composition of this invention as the internal phase, and maintaining the contact for a time sufficient to disperse the material into the liquid carrier, wherein the composition is comprised of a mixture of a solvent and an enhancer for the solvent. The solvent is comprised of at least one ester of an unsaturated, long-chain fatty acid and the enhancer is comprised of one or more compounds selected from ethoxylated alkyl phenols, fatty acid aliphatic quaternary ammonium compounds, fatty acid heterocyclic quaternary ammonium compounds, glycols and amine oxides.

The unsaturated, long-chain fatty acids useful herein to produce the ester composition principally include oleic acid, linoleic acid, linolenic acid and mixtures thereof wherein these named acids are preferably present in a mixture of fatty acids in an amount in the range of from about 30 to about 100 percent.

For purposes of this invention, the term "vegetable oil" shall mean the non-toxic liquid extracted from the edible seeds of plants, especially the legumes. Examples of such legumes include soybeans, peanuts, beans, peas, clover and alfalfa. The natural liquid extracted from the seeds is principally comprised of esters of long-chain, unsaturated fatty acids such as oleic acid, linoleic acid and linolenic acid. In addition to being non-toxic, these natural liquids exhibit flash points in excess of about 500° F., ignition points in excess of about 800° F. and fusion points lower than about −10° F. The liquids are biodegradable, that is, they are capable of being readily decomposed by microbial action, and they exhibit low chemical oxygen demand (COD), that is, the amount of oxidizing agent needed to oxidize the organic matter is low enough to permit their disposal in municipal waste water systems.

The ester composition preferred for use herein is not the natural liquid extracted from seeds as described above. It is, instead, a modified natural liquid, such as modified soybean oil, which has been treated with an alkyl alcohol to thereby form the ester.

2. Description of the Preferred Embodiments

A liquid composition identified by the trademark SOYGOLD 1100 is said by the source thereof to exhibit and provide the solvency properties and benefits desired of the ester to be employed in the composition of this invention. The source, AG ENVIRONMENTAL PRODUCTS L.L.C. of Lenexa, Kan., sometimes referred to as AEP, states that SOYGOLD 1100 industrial solvent contains no petroleum distillates, is low in VOCS, replaces d-limonene, has a high flash point (300° F.+), is non-toxic, is biodegradable and is insoluble in water. AEP describes the composition as being a combination of Alkyl $CH_2(OOCRa)CH(OOCRb)CH_2$ fatty acid methyl esters produced from 100% natural whole soybean oil and further identifies the composition by chemical abstract number 67784-80-9.

It is well known that soybean oil is a fixed oil, that is, a fatty oil, obtained by a process which comprises contacting flaked soybeans with a petroleum solvent, such as hexane, to dissolve the oil from the flake whereby an extract phase is formed. The extract phase is then distilled to remove the petroleum solvent and produce a raw oil product which is then treated with an alkali to remove free fatty acids to thereby produce the edible vegetable oil known as soybean oil.

The chief constituents of fats and oils are naturally occurring esters of fatty acids and glycerol, referred to as triglycerides, which have the general formula $CH_2(OOCRa)CH(OOCRb)CH_2(OOCRc)$ wherein Ra, Rb and Rc can be saturated and unsaturated alkyl groups having the same or different number of carbon atoms in the groups. In this regard, soybean oil is a triglyceride containing a major quantity of oleic acid, linoleic acid and linolenic acid which are unsaturated fatty acids of the same chain length. It is, thus, believed that the combination of alkyl fatty acid methyl esters referred to above as SOYGOLD 1100 is made by treating soybean oil by a known process to strip away and remove the glycerol backbone thereof to thereby produce free acids which are then reacted with methanol to produce the combination of methyl esters. For purposes of this invention this particular product is referred to as methylated soybean oil, which is also sometimes referred to herein as MESO.

The methylated soybean oil useful in this invention does exhibit the desirable solvent properties which have been previously noted. However, the material, when employed by itself in concentrated form, has been observed to lack features considered by persons skilled in the art to be essential to the efficient performance of a cleaning process and to the acquisition of a successful cleaning result. These problems are seen to be particularly serious when the surfaces to be cleaned are the interior surfaces of large metal containers, such as those employed in the refining and chemical processing of hydrocarbon feedstocks, such as crude petroleum oil.

Thus, it would be desirable to be able to prepare a cleaning material which contains a minor, yet effective, concentration of cleaning composition in a major concentration of carrier to enable complete contact between the cleaning composition and the contaminated interior surfaces of large vessels. This result is achieved in accordance with this invention by mixing with the methylated soybean oil at least one compound to form a composition which, upon contact with water, forms an aqueous external emulsion. The emulsion formed is sufficiently stable to permit it to be circulated over the surfaces to be cleaned without separation; it is effective to disperse, if not dissolve, hydrocarbon components to thereby remove deposits of such components from the surface to be cleaned; and it is able trap the removed components in the circulating emulsion for transport from the vessel to an appropriate disposal site.

In addition to the above, at least one compound is mixed with the methylated soybean oil to render the mentioned emulsion sufficiently unstable to permit the separation of the emulsion into an oil phase and a water phase upon standing for a reasonable period of time of about 12 to about 24 hours. The unstable feature of the composition enables the separated oil phase to be skimmed by known means from the liquid for oil recovery and disposal or reuse of the aqueous phase in a later cleaning operation.

The methylated soybean oil, by itself, produces an oil-wet surface, accordingly, at least one compound is mixed with it to enable the composition to produce a water-wet surface while retaining the desirable cleaning features previously mentioned.

The emulsion formation, separation and water wetting characteristics mentioned above can be produced by the addition of one compound or several compounds to the ester as described below.

Accordingly, the methylated soybean oil is modified by admixing therewith one or more liquid phase compounds selected from the group consisting of ethoxylated alkyl phenols, saturated and unsaturated fatty acid aliphatic quaternary ammonium compounds, saturated and unsaturated fatty acid heterocyclic quaternary ammonium compounds, glycols, amine oxides and mixtures thereof to thereby produce the composition which appears to be a clear homogeneous solution but which, in some aspects, is an oil external/aqueous internal micro-emulsion.

The ethoxylated alkyl phenols useful herein are octyl and nonyl phenols having in the range of 4 to 10 ethylene oxide units per molecule represented by the general formula (1)

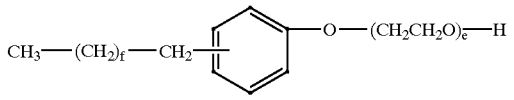

wherein f=6 to 7 and e=4 to 10.

Specific examples of ethoxylated alkyl phenols useful herein are ethoxylated octyl and nonylphenols having 9.5 ethylene oxide units, 8 ethylene oxide units and 4 ethylene oxide units.

The saturated and unsaturated fatty acid aliphatic quaternary ammonium compounds useful herein are hydroxyethyl, dihydroxypropyl and polyethoxy stearaminium and linolenaminium compounds having in the range of 24 to 35 carbon atoms per molecule represented by the general formula (2)

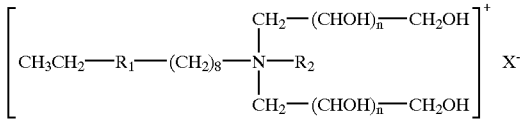

wherein $R_1$=—$(cH_2)8$— and —CH=$(CHCH_2CH=)_2CH$—, $R_2$=—$CH_2$—$(CHOH)_mCH_2OH$ and —$(CH_2CH_2O—)_aH$, X=halides, nitrates, nitrites, sulfites, sulfates, carboxylates, and lower alkyl sulfates, n=0 or 1, m=0 or 1 and a=1 to 5.

Specific examples of fatty acid aliphatic quaternary ammonium compounds useful herein are bis-hydroxyethyl dihydroxypropyl stearaminium chloride and dihydroxypropyl polyethoxy linolenaminium chloride.

The fatty acid heterocyclic quaternary ammonium compounds useful herein are ethyl, hydroxyethyl, stearic and linolenic imidazolinium compounds having in the range of 24 to 25 carbon atoms per molecule represented by the general formula (3)

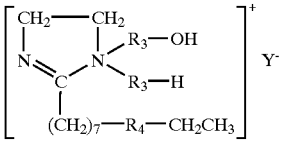

wherein $R_3$=—$CH_2CH_2$—, $R_4$=$(CH_2)_8$— and —CH=$(CHCH_2CH=)_2CH$—, Y=halides, nitrates, nitrites, sulfites, sulfates, carboxylates, and lower alkyl sulfates.

An example of a fatty acid heterocyclic quaternary ammonium compound useful herein is 2-isostearyl 1-hydroxyethyl 1-ethyl imidazolinium ethylsulfate.

The glycols useful herein are di- and triethylene glycols and di- and tripropylyene glycols and methyl ethers thereof represented by the general formula
wherein

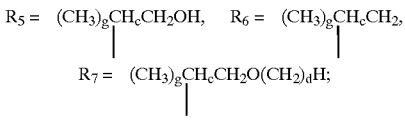

b=0 or 1, c=1 or 2, d=0 or 1, g=0 if c=2 and g=1 if c=1.

Specific examples of glycols useful herein are dipropylene glycol and tripropylene glycol methyl ether.

The amine oxides useful herein are tertiary amine oxides in which the amine nitrogen is bonded to one alkyl or one alkyloxy group having in the range of 9 to 21 carbon atoms and two alkyl or two alkyloxy groups having in the range of 1 to 4 carbon atoms. The amine oxides are represented by the general formula

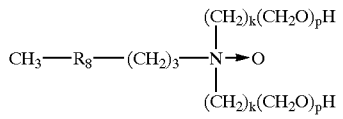

(5)

wherein $R_8$=—$(CH_2)_h$—$(O)_j$—, h=5 to 17, j=0 or 1, p=0 or 1 and k=1 to 3.

Examples of amine oxides useful herein are lauryldimethylamine oxide and bis-(2-hydroxyethyl) isodecyloxypropylamine oxide.

The composition of this invention, which, in one aspect, is a concentrated cleaning and decontamination additive, is made by merely mixing a quantity of a lower alkyl ester of at least one fixed oil with a quantity of one or more compounds required to impart the enhanced features described above. The lower alkyl esters are methyl, ethyl and propyl esters, preferably, methyl esters. The ester is present in the composition in an amount in the range of from about 20 to about 99, preferably from about 35 to about 95 and still more preferably from about 40 to about 92 parts by weight of active ester per 100 parts by weight of composition. In specific preferred embodiments the ester is present in ranges of from about 50 to about 95, from about 70 to about 85, and from about 80 to about 95 percent by weight of the composition.

The fixed oils preferred for use are unsaturated, long-chain fatty acids, and mixtures thereof, having in the range of 14 to 20 and preferably 16 to 18 carbon atoms per molecule. The fatty acids preferred herein to produce the ester principally include oleic acid, linoleic acid, linolenic acid and mixtures thereof wherein these named acids are preferably present in a mixture of fatty acids in an amount in the range of from about 30 to about 100 percent.

As previously described, the alkyl esters useful herein can be prepared from naturally occurring vegetable oils which have been modified to convert the triglycerides to free acids followed by reacting the acids with an alkyl alcohol. The most preferred ester is modified soybean oil which has been reacted with methyl alcohol.

The balance of the cleaning additive of this invention is comprised of at least one compound to provide the enhanced features previously mentioned. In this regard, it has been surprisingly discovered that the ester and an ethoxylated alkyl phenol, preferably a nonyl phenol, having in the range of from about 4 to about 6, preferably 4, ethylene oxide units per molecule, when present in the additive in an amount in the range of from about 15 to about 20, preferably from about 17 to about 19, parts per 100 parts by weight of additive serves to provide the emulsion, separation and water-wetting features of the invention. This aspect of the invention, which can include from 0 to about 10 percent glycol and diluents, is illustrated in Table 4-C, below, as additives 8 and 15.

It also has been discovered that the ester together with a combination comprised of at least two different compounds including a glycol and a fatty acid heterocyclic quaternary ammonium compound, serves to provide the emulsion, separation and water-wetting features of the invention. In this aspect the glycol is present in the additive in an amount in the range of from about 4 to about 6 parts per 100 parts by weight of additive; and the fatty acid heterocyclic quaternary ammonium compound is present in the additive in an amount in the range of from about 3 to about 5 parts per 100 parts by weight of additive. The results produced by this combination are surprising because each of these two compounds, when acting alone or in combination in different concentrations with the ester, failed to produce the emulsion, separation and water-wetting features of the invention. This aspect of the invention, which can include from 0 to about 8 percent ethoxylated alkyl phenol and diluents, is shown in Table 4-C, below, as additives 17, 18, 19 and 25.

It has been further discovered that the ester together with a combination comprised of at least three different compounds including a glycol, a fatty acid aliphatic quaternary ammonium compound and an ethoxylated alkyl phenol serves to provide the emulsion, separation and water-wetting features of the invention. In this aspect the glycol is present in the additive in an amount in the range of from about 1 to about 15, preferably from about 4 to about 8, parts per 100 parts by weight of additive; the fatty acid aliphatic quaternary ammonium compound is present in the additive in an amount in the range of from about 1 to about 5, preferably from about 2 to about 3, parts per 100 parts by weight of additive; and the ethoxylated alkyl phenol is present in the additive in an amount in the range of from about 15 to about 30, preferably from about 17 to about 19, parts per 100 parts by weight of additive. The glycol and fatty acid aliphatic quaternary ammonium compound each when acting alone in combination with the ester failed to produce the emulsion, separation and water-wetting features of the invention. However, addition of the ethoxylated alkyl phenol to a combination of glycol and fatty acid aliphatic quaternary ammonium compound, surprisingly, produced the emulsion, separation and water-wetting features of this invention. This aspect of the invention, which can include from 0 to about 5 percent diluent, is shown in Table 4-C, below, as additives 20 and 22.

Additive 24 of Table 4-C is believed to be a special variation of additives 20 and 22 mentioned above. In this regard, additive 24 not only performs the deposit removal, emulsion, separation and water-wetting features of the invention, but also converts hazardous sulfur compounds which may be present in a deposit to nonhazardous water insoluble species as disclosed in a number of prior U.S. Patents such as U.S. Pat. No. 5,807,476 to Collins et al. The sulfur converting aspect of additive 24 is provided by the inclusion of an amine oxide in additives 20 and 22 together with an adjustment of concentrations. Since an amine oxide is an oxidizing agent an increase in glycol and ethoxylated alkyl phenol concentration is indicated. Thus, in this aspect, the glycol is present in the additive in an amount in the range of from about 10 to about 15, preferably about 12, parts per 100 parts by weight of additive; the fatty acid aliphatic quaternary ammonium compound is present in the additive in an amount in the range of from about 1 to about 6, preferably 1 to about 2 parts per 100 parts by weight of additive, the ethoxylated alkyl phenol is present in the additive in an amount in the range of from about 20 to about 30, preferably about 25, parts per 100 parts by weight of additive; and the amine oxide is present in the additive in an amount in the range of from about 10 to about 50, preferably from about 10 to about 15, and more preferably about 12, parts per 100 parts by weight of additive.

It is evident that the composition of this invention enjoys a wide variation in ingredients and concentrations from which to select to achieve a result desired by a particular user. Accordingly, a person skilled in the art, guided by this disclosure, can conduct tests within the skill of the art to determine particular ingredients and concentrations thereof to obtain a desired result. Thus, in broad terms, the composition comprises an ester, as previously described, present in the composition in an amount in the range of from about 35 to about 99 percent by weight and at least one other compound present in the composition as follows: ethoxylated octyl and nonyl phenols, 0 to about 35, preferably 0 to about 25, percent by weight; glycols, 0 to about 20, preferably 0 to about 15, percent by weight; quaternary ammonium compounds, 0 to about 15, preferably 0 to about 12, and still more preferably, 0 to about 6 percent by weight; and amine oxides, 0 to about 50, preferably, 0 to about 15, and still more preferably 0 to about 12 percent by weight of said composition. The composition can also include extenders and diluents, such as silicone oil, N-methyl pyrolidone and the like, in quantities up to about 10 percent by weight of the composition.

The composition can be employed alone or added directly to prior art hydrocarbon solvents or to an aqueous carrier to dissolve, or at least to disperse, deposits of hydrocarbon components. Accordingly, the quantity of composition present in a particular cleaning formulation is an amount in the range of from about 0.1 to about 100 parts by volume composition per 100 parts by volume of cleaning formulation. When the composition is added to oil or water it is preferably present in an amount in the range of from about 0.5 to about 20, and more preferably in the range of from about 1 to about 5 parts by volume composition per 100 parts by volume of cleaning formulation. It is important to understand that the composition of this invention is not soluble in water. Accordingly, when the composition is added to a water carrier an aqueous external emulsion is formed which operates to dissolve, or at least to disperse, deposits of hydrocarbon components.

The composition when employed alone or added directly to prior art hydrocarbon solvents is particularly useful to dissolve, disperse or reduce the density and viscosity of large volumes of dense and viscous hydrocarbon components. Examples of such uses are provided below. However, a preferred use of the composition of this invention is as an additive to an aqueous carrier to form an aqueous external emulsion to remove deposits of hydrocarbon components from various surfaces, including metal surfaces and concrete surfaces. In this regard, the aqueous carrier may be in liquid phase or in vapor phase. In liquid phase, the temperature of the cleaning formulation can be in the range of from about 32 to about 212, and preferably in the range of from about 68 to about 180° F. In vapor phase, the cleaning formulation is comprised of the composition dispersed in steam having a pressure in the range of from about 10 to about 300, preferably from about 100 to about 300, and more preferably about 150 psig.

The composition, particularly when employed as an additive for water or a hydrocarbon solvent, also can be used to treat hydrocarbon product streams and crude streams, including petroleum in downhole situations, to aid in the removal of contamination from such streams.

A method of removing deposits comprised of hydrocarbon components from the interior surface of a vessel, such as a petroleum distillation column or a product pipeline, is comprised of a preparation stage and a deposit treatment stage. In subsequent stages the removed hydrocarbon components can be processed by known means to recover useful products and water employed in the cleaning can be reused for further cleaning or sent to the sewer.

The preparation stage is comprised of the steps of terminating the flow of the process fluid, such as petroleum, into and from the vessel; isolating the vessel from adjacent equipment and lines, such as by the installation of blinds and closing valves; cooling and reducing the viscosity of process fluid remaining in the vessel by adding an appropriate cool-down liquid to the vessel; and removing the thinned and cooled process fluid from the vessel. The composition of this invention can be added to the cool-down fluid and circulated therewith to thin and/or dissolve more sludge than the cool-down fluid would normally remove.

The deposit treatment stage is comprised of the steps of filling the vessel with the required volume of liquid water; circulating the water through the vessel along with heating; adding the composition of this invention, by pre-mixing, or by direct injection, to the circulating water to produce an aqueous external emulsion containing an amount of additive effective to disperse the deposit while maintaining a desired treating temperature; removing the emulsion containing dispersed deposit from the vessel and placing the removed emulsion in an appropriate storage location; adding new water and composition to replace the emulsion removed; analyzing the removed emulsion to determine the concentration of hydrocarbon component or residual composition present therein; and continuing the above steps until the concentration of hydrocarbon component in the removed emulsion attains a desired level or the concentration of residual composition remains relatively constant.

In a variation of the above method, steam is employed in place of liquid water and the composition of this invention is added to injected steam instead of to circulating liquid water. In this variation hydrocarbon vapors generated by the steam are directed to flares for burning and steam contaminated with hydrocarbon components are condensed and the condensate is placed in an appropriate storage location.

The cool-down liquid referred to in the preparation stage is ordinarily a hydrocarbon, such as diesel oil, having a viscosity lower than the viscosity of the process fluid and is intended to reduce the viscosity of heavy hydrocarbons and thick deposits.

The volume of water or steam required to be introduced into the vessel to be cleaned is an amount in the range of from about 0.1 to about 2, and preferably about 1.3 times the total volume of the vessel to be cleaned. The amount of composition of this invention effective to disperse the deposits into the circulating emulsion, as previously stated, is believed to be an amount in the range of from about 0.5 to about 25, preferably from about 1 to about 10 and still more preferably an amount in the range of from about 2 to about 5 volume parts composition per 100 parts by volume of water or steam. It is believed that a concentration of about 2% by volume is sufficient to treat the majority of deposits, but a concentration of composition at a 5% volume level is believed to be indicated to treat especially heavy sludge concentrations in the event that insufficient cool-down liquid is not employed during the preparation stage.

The temperature of the circulating emulsion is in the range of from about 68 to about 240° F.

EXAMPLE 1

Test liquids consisting of water, oil and a cleaning formulation were tested to determine the emulsification and phase separation properties of each test liquid. The tests were conducted in accordance with the following procedures.

Preparation of Test Liquids

Each test liquid was prepared by mixing a fixed volume of a cleaning formulation with a fixed volume of a base mixture consisting of water and oil. In this regard, the base mixture consisted of 100 milliliters of demineralized water and 20 milliliters of crude oil produced from the Bartlesville formation in Northeastern Oklahoma. The cleaning formulation consisted of 2 milliliters of a chemical ingredient or a combination of ingredients as identified in Table 1-A, below. Accordingly, each test liquid consisted of 100 milliliters of demineralized water, 20 milliliters of Bartlesville crude oil and 2 milliliters of a cleaning formulation, hereinafter referred to as the cleaning additive or as the additive test liquid.

The chemical ingredients of the cleaning additives shown in Table 1-A are specifically defined in Table 1-B, below.

Each test liquid was prepared by introducing into a 300 milliliter transparent glass beaker the noted volume of water and the noted volume of oil. The water and oil were mixed together to produce a two phase base mixture consisting of discrete, visible globules of oil dispersed in a continuous aqueous phase. Thereafter, the noted volume of cleaning additive was added to the base mixture in the beaker and the entire mass was heated and stirred in the beaker on a hotplate equipped with a magnetic stirrer to a temperature of 180° F.

While the test liquid was being heated and stirred, as just described, it was observed to determine whether or not a visible aqueous external/oil internal emulsion was formed and, if so, the appearance and stability thereof and whether or not the above described appearance of the base mixture changed and, if so, the duration of the change. The observations are reported in Table 1-C, below, under the heading, "Emulsion."

Upon attaining the desired temperature of 180° F., the beaker containing the test liquid was placed in a water bath whose temperature was controlled at a value of about 113° F. The test liquid was maintained in the heated bath without stirring to permit phase separation and observed approximately every 30 minutes during the day and then after sitting overnight. Each test liquid was allowed to remain undisturbed for about 18 hours. Thereafter, each test liquid was observed to determine whether or not the constituents of the test liquid had separated to form a visible water phase, and, if so, the color and clarity of the water phase. The observations are reported in Table 1-C, below, under the heading, "Separation."

TABLE 1-A

CLEANING ADDITIVES

| | ADDITIVE NUMBER | | | | | | |
|---|---|---|---|---|---|---|---|
| | 1 | 2 | 3 | 4 | 5 | 6 | 7 |
| COMPONENT | Quantity of Component, milliliters | | | | | | |
| MESO | 50.0 | 50.0 | 50.0 | 50.0 | 50.0 | 50.0 | 50.0 |
| DPG | | 5.0 | | | | | |
| ISIES | | | 2.0 | | | | |
| BHEDPSC | | | | 1.0 | | | |
| DHPPELC | | | | | 1.0 | | |
| LDMAO | | | | | | 25.0 | |
| NDET 9.5 | | | | | | | 10.0 |

| | ADDITIVE NUMBER | | | | | | |
|---|---|---|---|---|---|---|---|
| | 8 | 9 | 10 | 11 | 12 | 13 | 14 |
| COMPONENT | Quantity of Component, milliliters | | | | | | |
| MESO | 50.0 | 50.0 | 50.0 | 50.0 | 50.0 | 50.0 | 50.0 |
| DPG | | | 5.0 | 5.0 | 5.0 | 5.0 | 5.0 |

TABLE 1-A-continued

CLEANING ADDITIVES

| | | | | | | | |
|---|---|---|---|---|---|---|---|
| ISIES | | | 2.0 | | | | |
| BHEDPSC | | | | 1.0 | | | |
| DHPPELC | | | | | 1.0 | | |
| LDMAO | | | | | | 25.0 | |
| NDET 9.5 | | | | | | | 10.0 |
| NDET 4 | 10.0 | | | | | | |
| TPG | | 5.0 | | | | | |

| | ADDITIVE NUMBER | | | | | | |
|---|---|---|---|---|---|---|---|
| | 15 | 16 | 17 | 18 | 19 | 20 | 21 |
| COMPONENT | Quantity of Component, milliliters | | | | | | |
| MESO | 50.0 | 50.0 | 50.0 | 50.0 | 50.0 | 50.0 | 50.0 |
| DPG | 5.0 | 5.0 | 2.0 | 2.0 | 2.0 | 1.5 | 2.0 |
| ISIES | | | 2.0 | 2.0 | 2.0 | | 2.0 |
| BHEDPSC | | | | | | 1.0 | |
| DHPPELC | | | | | | 1.0 | |
| LDMAO | | | | | | | 25.0 |
| NDET 9.5 | | | | | 3.0 | | |
| NDET 4 | 10.0 | | | | | 5.0 | 15.0 |
| TPG | | 5.0 | | | 1.0 | 1.0 | 2.0 |
| SO | | | | 2.5 | | | |
| NDET 8 | | | | | | 5.0 | 10.0 |

| | ADDITIVE NUMBER | | | | |
|---|---|---|---|---|---|
| | 22 | 23 | 24 | 25 | 26 |
| COMPONENT | Quantity of Component, milliliters | | | | |
| MESO | 50.00 | 50.00 | 50.00 | 50.00 | 50.00 |
| DPG | 5.00 | 2.00 | 7.50 | 2.50 | 2.50 |
| BHEDPSC | 1.00 | | 0.75 | | 2.50 |
| DHPPELC | 1.00 | | 0.75 | | |
| LDMAO | | 25.00 | 25.00 | | |
| NDET 4 | 1.25 | 20.00 | 10.00 | | |
| TPG | | 2.00 | 2.50 | | |
| NDET 8 | 10.00 | 10.00 | 10.00 | | 2.50 |
| NM2P | 2.50 | | | 2.50 | |
| ISIES | | | | 2.00 | |
| NDET 9.5 | | | | | 5.00 |

TABLE 1-B

INGREDIENTS OF CLEANING ADDITIVES

| CODE NUMBER | CHEMICAL NAME | Specific Gravity, grams/ml | Activity, percent |
|---|---|---|---|
| NDET 8 | NONYLPHENOL ETHOXYLATE T-DET-N-8 | 1.05 | 100 |
| NDET 4 | NONYLPHENOL ETHOXYLATE T-DET-N-4 | 1.02 | 100 |
| DPG | DIPROPYLENE GLYCOL | 1.024 | 100 |
| TPG | TRIPROPYLENE GLYCOL METHYL ETHER | 0.96 | 100 |
| LDMAO | LAURYLDIMETHYL-AMINE OXIDE | 0.96 | 30 (70% water) |
| MESO | METHYL ESTER OF MODIFIED SOYBEAN OIL | 0.87 | 100 |

TABLE 1-B-continued

| INGREDIENTS OF CLEANING ADDITIVES | | | |
|---|---|---|---|
| CODE NUMBER | CHEMICAL NAME | Specific Gravity, grams/ml | Activity, percent |
| BHEDPSC | BIS HYDROXYETHYL DIHYDROXYPROPYL STEARAMINIUM CHLORIDE IN COMBINATION WITH HEXYLENE GLYCOL | 0.98 | 100 |
| DHPPELC | DIHYDROXYPROPYL POLYETHOXY LINOLENAMINIUM CHLORIDE | 1.0 | 60 (40% water) |
| NDET 9.5 | NONYLPHENOL ETHOXYLATE T-DET-N-9.5 | 1.05 | 100 |
| ISIES | 2-ISOSTEARYL 1-HYDROXYETHYL 1-ETHYL IMIDAZOLINIUM ETHYLSULFATE | 1.0 | 100 |
| NM2P | N-METHYL-2-PYROLIDONE | 1.032 | 100 |
| SO | SILICONE OIL | 1.0 | 100 |

TABLE 1-C

| EMULSIFICATION AND SEPARATION PROPERTIES OF TEST LIQUIDS | | | |
|---|---|---|---|
| TEST LIQUID | ADDITIVE | EMULSION | SEPARATION WATER PHASE CLARITY/COLOR |
| A | 1 | NO | CLEAR |
| B | 2 | NO | CLEAR |
| C | 3 | NO | CLEAR/AMBER |
| D | 4 | YES | TRANSLUCENT |
| E | 5 | YES | CLEAR/GREY |
| F | 6 | YES | TRANSLUCENT/ DARK AMBER |
| G | 7 | YES | OPAQUE/GREY |
| H | 8 | YES | CLEAR/ SLIGHT AMBER |
| I | 9 | NO | CLEAR |
| J | 10 | YES | CLEAR/AMBER |
| K | 11 | YES | CLEAR |
| L | 12 | YES | CLEAR |
| M | 13 | YES | TRANSLUCENT/ WHITE |
| N | 14 | YES | OPAQUE/WHITE |
| O | 15 | YES | CLEAR |
| P | 16 | NO | CLEAR |
| Q | 17 | YES | CLEAR/AMBER |
| R | 18 | YES | CLEAR/AMBER |
| S | 19 | YES | CLEAR/AMBER |
| T | 20 | YES | CLEAR |
| U | 21 | YES | OPAQUE |
| V | 22 | YES | CLEAR |
| W | 23 | YES | OPAQUE |
| X | 24 | YES | CLEAR/AMBER |
| Y | 25 | YES | CLEAR |
| Z | 26 | YES | CLEAR/AMBER |

EXAMPLE 2

The additives listed in Tables 1-A and 1-C were examined to determine whether a film of water or whether a film of oil remained on a painted metal surface after first contacting the surface with the additive and then attempting to remove the additive from the surface. The surface was observed after removal of the additive. If beads of water were visible on the surface, then it was concluded that a film of oil was on the surface. If beads of water were not visible on the surface, then it was concluded that a film of water was on the surface.

The test results are shown in Table 2, below. The word "yes" indicates that a film of oil was present on the surface (beads of water were present). The word "no" indicates that a film of oil was not present on the surface (beads of water were not present) and, therefore, the surface was covered by a film of water.

The removal of the additive from the painted surface was attempted by three different techniques referred to as: (1) the dry wipe test; (2) the wet wipe test; and (3) the rinse test. According to the dry wipe test, a small quantity of the additive was spread on a clean, film-free, metal surface and then wiped off with a dry paper towel. The surface was then contacted with a spray of water emitted from a hand-held spray bottle. The surface was then observed to determine the presence or absence of beads of water. According to the wet wipe test, a small quantity of the additive was spread on a clean, film-free, metal surface and then wiped off with a water-damp paper towel. The surface was then contacted with a spray of water emitted from a hand-held spray bottle. The surface was then observed to determine the presence or absence of beads of water. According to the rinse test, a small quantity of the additive was spread on a clean, film-free, metal surface and then contacted with a spray of water from a garden hose or a hand sprayer for a period of two minutes. The surface was then observed to determine the presence or absence of beads of water.

TABLE 2

| FILM FORMING TESTS | | | |
|---|---|---|---|
| ADDITIVE | DRY WIPE TEST OIL FILM | WET WIPE TEST OIL FILM | RINSE TEST OIL FILM |
| 1 | YES | YES | YES |
| 2 | YES | YES | YES |
| 3 | YES | YES | YES |
| 4 | YES | YES | YES |
| 5 | YES | YES | YES |
| 6 | NO | NO | NO |
| 7 | YES | NO | NO |
| 8 | NO | NO | NO |
| 9 | YES | YES | YES |
| 10 | YES | YES | YES |
| 11 | YES | YES | YES |
| 12 | YES | YES | YES |
| 13 | YES | NO | NO |
| 14 | YES | NO | NO |
| 15 | YES | YES | NO |
| 16 | YES | YES | YES |
| 17 | NO | NO | NO |
| 18 | NO | NO | NO |
| 19 | NO | NO | NO |
| 20 | NO | NO | NO |
| 21 | NO | NO | NO |
| 22 | NO | NO | NO |
| 23 | NO | NO | NO |
| 24 | NO | NO | NO |
| 25 | NO | NO | NO |
| 26 | NO | NO | NO |

TABLE 3

SUMMARY OF RESULTS SHOWN IN TABLE 1-C AND TABLE 2

| CATEGORY | ADDITIVE | EMULSION FORMED? | SEPARATION? | SURFACE WATER WET? |
|---|---|---|---|---|
| 1 | 1 | NO | YES | NO |
| 1 | 2 | NO | YES | NO |
| 1 | 3 | NO | YES | NO |
| 1 | 9 | NO | YES | NO |
| 1 | 16 | NO | YES | NO |
| 2 | 4 | YES | YES | NO |
| 2 | 5 | YES | YES | NO |
| 2 | 10 | YES | YES | NO |
| 2 | 11 | YES | YES | NO |
| 2 | 12 | YES | YES | NO |
| 3 | 6 | YES | NO | YES |
| 3 | 7 | YES | NO | YES |
| 3 | 13 | YES | NO | YES |
| 3 | 14 | YES | NO | YES |
| 3 | 21 | YES | NO | YES |
| 3 | 23 | YES | NO | YES |
| 4 | 8 | YES | YES | YES |
| 4 | 15 | YES | YES | YES |
| 4 | 17 | YES | YES | YES |
| 4 | 18 | YES | YES | YES |
| 4 | 19 | YES | YES | YES |
| 4 | 20 | YES | YES | YES |
| 4 | 22 | YES | YES | YES |
| 4 | 24 | YES | YES | YES |
| 4 | 25 | YES | YES | YES |
| 4 | 26 | YES | YES | YES |

As shown in Table 3, the results obtained in Examples 1 and 2 are placed in four categories including category 1 (additives 1, 2, 3, 9 and 16), category 2 (additives 4, 5, 10, 11 and 12), category 3 (additives 6, 7, 13, 14, 21 and 23) and category 4 (additives 8, 15, 17, 18, 19, 20, 22, 24, 25 and 26).

Category 1 results show that an emulsion was not produced from the base mixture of oil and water; that a water wet surface was not produced; and that the base mixture did separate. Accordingly, it is concluded that the various additives employed in the category 1 test liquids failed to function as emulsifiers and failed to form a water film on the test surface. Additive 1, included in category 1, contains methylated soybean oil and no other component. It follows that any additive which produces the results shown for additive 1 is not an example of the invention, and that category 1 results are standards against which all other results are to be measured. Accordingly, glycols and mixtures of glycols and the heterocyclic quaternary ammonium compound included in additives 2, 3, 9 and 16, in combination with methylated soybean oil, failed to function as emulsifiers and failed to form a water film on the test surface.

Category 2 results show that an emulsion was produced from the base mixture of oil and water; that a water wet surface was not produced and that the emulsion did separate.

Category 3 results show that an emulsion was produced from the base mixture of oil and water; that a water wet surface was produced and that the emulsion did not separate.

Category 4 results show that an emulsion was produced from the base mixture of oil and water; that a water wet surface was produced and that the emulsion did separate.

TABULATED RESULTS

The results obtained in Examples 1 and 2 and the reports thereof contained in Tables 1–3 were combined. The composite results are set forth in Table 4 which indicates, for each test liquid, whether the test liquid formed an emulsion, E, which separated, S, upon standing and whether the additive employed in the test liquid produced a water wet surface, R. That a particular test liquid or additive did comply with one of the mentioned standards is indicated by the letter "x" placed under the columns E, S and R.

In addition, Table 4 includes the percentage concentration by weight of each component in each additive employed in each test liquid, wherein the weight percentages were calculated from the volumes employed as reported in Table 1-A and the specific gravities and activities reported in Table 1-B.

The test results are divided into five groups, wherein the items included in each group achieved the same results with regard to each of the mentioned observations: emulsion formation, E, emulsion separation, S, and water wetting, R. The order of presentation in each group corresponds to decreasing concentration of methyl ester of modified soybean oil (MESO) employed in each additive. It is noted that all of the test liquids and additives tested contained MESO. As an aid to the understanding of Table 4, note, for example, Table 4-C and observe that test liquid S contained additive 19 and that additive 19 contained 84.21 percent MESO, 6.1 percent ethoxylated nonyl phenol having 9.5 ethylene oxide units, 5.82 percent glycol (DPG and TPG) and 3.87 percent quaternary ammonium compound (ISIES).

TABLE 4-A

COMBINED AND TABULATED RESULTS OF TABLES 1–3

| Group | Test Liquid & Additive | | Pass Test E | S | R | Glycols DPG wt % | TPG wt % | Quaternary Compounds ISIES wt % | BHEDPSC wt % | DHPPELC wt % | Ester MESO wt % |
|---|---|---|---|---|---|---|---|---|---|---|---|
| 1 | A | 1 | | x | | | | | | | 100.00 |
| 2 | C | 3 | | x | | | | 4.4 | | | 95.6 |
| 2 | I | 9 | | x | | | 9.94 | | | | 90.06 |
| 2 | B | 2 | | x | | 10.53 | | | | | 89.47 |
| 2 | P | 16 | | x | | 9.58 | 8.99 | | | | 81.43 |
| 3 | E | 5 | x | x | | | | | | 1.36 | 98.64 |
| 3 | D | 4 | x | x | | | | | 2.2 | | 97.8 |
| 3 | L | 12 | x | x | | 10.4 | | | | 1.22 | 88.38 |
| 3 | K | 11 | x | x | | 10.32 | | | 1.98 | | 87.7 |
| 3 | J | 10 | x | x | | 10.11 | | 3.95 | | | 85.94 |

TABLE 4-B

COMBINED AND TABULATED RESULTS OF TABLES 1–3

| Group | Test Liquid & Additive | | Pass Test E | S | R | Glycols DPG wt % | TPG wt % | Quaternary Compounds ISIES wt % | BHEDPSC wt % | DHPPELC wt % | Ester MESO wt % |
|---|---|---|---|---|---|---|---|---|---|---|---|
| 4 | G | 7 | x | | x | | | | | | 80.56 |
| 4 | N | 14 | x | | x | 8.66 | | | | | 73.58 |
| 4 | F | 6 | x | | x | | | | | | 64.44 |
| 4 | M | 13 | x | | x | 7.05 | | | | | 59.90 |
| 4 | U | 21 | x | | x | 2.06 | 2.10 | 2.01 | | | 43.82 |
| 4 | W | 23 | x | | x | 2.00 | 1.87 | | | | 42.49 |

| Group | Test Liquid & Additive | | Pass Test E | S | R | Ethoxylated Alkyl Phenols NDET4 wt % | NDET8 wt % | NDET9.5 wt % | Amine Oxide LDMAO wt % | Ester MESO wt % |
|---|---|---|---|---|---|---|---|---|---|---|
| 4 | G | 7 | x | | x | | | 19.44 | | 80.56 |
| 4 | N | 14 | x | | x | | | 17.76 | | 73.58 |
| 4 | F | 6 | x | | x | | | | 10.66 | 64.44 |
| 4 | M | 13 | x | | x | | | | 9.91 | 59.90 |
| 4 | U | 21 | x | | x | 15.41 | 10.58 | | 7.25 | 43.82 |
| 4 | W | 23 | x | | x | 19.93 | 10.26 | | 7.03 | 42.49 |

TABLE 4-C

COMBINED AND TABULATED RESULTS OF TABLES 1–3

| Group | Test Liquid & Additive | | Pass Test E | S | R | Glycols DPG wt % | TPG wt % | Quaternary Compounds ISIES wt % | BHEDPSC wt % | DHPPELC wt % | Ester MESO wt % |
|---|---|---|---|---|---|---|---|---|---|---|---|
| 5 | Q | 17 | x | x | x | 4.31 | | 4.2 | | | 91.49 |
| 5 | R | 18 | x | x | x | 4.09 | | 3.99 | | | 86.92 |
| 5 | Y | 25 | x | x | x | 5.06 | | 3.95 | | | 85.9 |
| 5 | S | 19 | x | x | x | 3.96 | 1.86 | 3.87 | | | 84.21 |
| 5 | H | 8 | x | x | x | | | | | | 81.01 |
| 5 | Z | 26 | x | x | x | 4.54 | | | 4.35 | | 77.15 |
| 5 | T | 20 | x | x | x | 2.65 | 1.66 | | 1.69 | 1.04 | 75.1 |
| 5 | O | 15 | x | x | x | 8.71 | | | | | 73.95 |
| 5 | V | 22 | x | x | x | 7.93 | | | 1.52 | 0.92 | 67.38 |
| 5 | X | 24 | x | x | x | 7.70 | 2.40 | | 0.74 | 0.45 | 43.60 |

TABLE 4-C-continued

COMBINED AND TABULATED RESULTS OF TABLES 1–3

| Group | Test Liquid & Additive | | Pass Test E | S | R | Ethoxylated Alkyl Phenols NDET4 wt % | NDET8 wt % | NDET9.5 wt % | Amine Oxide LDMAO wt % | Other NM2P wt % | SO wt % | Ester MESO wt % |
|---|---|---|---|---|---|---|---|---|---|---|---|---|
| 5 | Q | 17 | x | x | x | | | | | | | 91.49 |
| 5 | R | 18 | x | x | x | | | | | | 5.00 | 86.92 |
| 5 | Y | 25 | x | x | x | | | | | 5.09 | | 85.9 |
| 5 | S | 19 | x | x | x | | | 6.1 | | | | 84.21 |
| 5 | H | 8 | x | x | x | 18.99 | | | | | | 81.01 |
| 5 | Z | 26 | x | x | x | | 4.66 | 9.31 | | | | 77.15 |
| 5 | T | 20 | x | x | x | 8.8 | 9.06 | | | | | 75.1 |
| 5 | O | 15 | x | x | x | 17.34 | | | | | | 73.95 |
| 5 | V | 22 | x | x | x | 1.98 | 16.27 | | | 4.00 | | 67.38 |
| 5 | X | 24 | x | x | x | 10.22 | 10.52 | | 7.22 | | | 43.60 |

Group 1 includes only test liquid A which contains no component other than MESO as the cleaning additive. Thus, the results achieved for MESO alone as the cleaning additive serves as the basis for comparison to determine the presence or absence of novel subject matter.

Group 2 includes test liquids C, I, B and P which achieved results identical to the results produced by test liquid A even though the test liquids in group 2 included at least one component in the additive in combination with MESO. Accordingly, the additives in the test liquids in group 2 do not indicate the presence of novel subject matter. It is evident that the test liquids in groups 1 and 2 did not form emulsions and the additives did not produce water wet surfaces. Based upon the presence of the heterocyclic quaternary ammonium compound in the additive of test liquid C, it was expected that test liquid C would have formed an emulsion. It was expected that the glycols, referred to as cosolvents, would not possess sufficient surface activity to form emulsions and that a water wet surface would not be produced.

Group 3 includes test liquids E, D, L, K and J which achieved results different than the results produced by test liquid A. In this regard, the test liquids in group 3 formed sufficiently weak or unstable emulsions to permit separation upon standing, but the additives employed did not produce water wet surfaces. The test liquids in group 3 included at least one component in the additive in combination with MESO. Accordingly, the additives in the test liquids in group 3 do indicate the presence of novel subject matter. The results produced by test liquid J were unexpected. It is believed that test liquid J should have achieved the same result produced by test liquids B and C in group 2. It is, accordingly, evident that the combination of cosolvent and heterocyclic quaternary ammonium compound produce results that these same components, when acting alone, will not produce.

Group 4 includes test liquids G, N, F, M, U and W which achieved results different than the results produced by test liquid A. In this regard, the test liquids in group 4 formed sufficiently strong or stable emulsions to prevent separation upon standing, but the additives employed did produce water wet surfaces. The test liquids in group 4 included at least one component in the additive in combination with MESO. Accordingly, the additives in the test liquids in group 4 do indicate the presence of novel subject matter.

Based on the results produced by the test liquids in group 4, it can be concluded that emulsions formed by ethoxylated alkyl phenols (which are known to be nonionic surfactants), amine oxides and mixtures thereof tend to be quite stable.

The test liquids in group 4 are heavily laden with materials, as previously indicated, which are strong emulsifiers and water wetting agents. Compare test liquid U with test liquid J from group 3. It would be expected that the results produced by these two test liquids would be the same. They were not. It is evident that the addition of the strong emulsifiers and water wetting agents of group 4 to the combination of cosolvent and heterocyclic quaternary ammonium compound produced the change in results.

Group 5 includes test liquids Q, R, Y, S, H, Z, T, O, V and X which achieved results different than the results produced by test liquid A. In this regard, the test liquids in group 5 formed sufficiently weak or unstable emulsions to permit separation upon standing, and the additives employed did produce water wet surfaces. The test liquids in group 5 included at least one component in the additive in combination with MESO. Accordingly, the additives in the test liquids in group 5 do indicate the presence of novel subject matter.

Test liquids H and O, even though containing high concentrations of ethoxylated alkyl phenol, produced emulsions weak enough to permit separation which result is contrary to the results produced in group 4 and therefore unexpected and surprising. In this regard compare the results produced by test liquids G, U and W, in group 4, with the results produced by test liquids H and O in group 5. It is concluded that the number of ethylene oxide units in the ethoxylated alkyl phenols employed was a significant contributor to the different results. These results further suggest that high concentrations of strong emulsifiers in combination with weak emulsifiers stabilize emulsions to prevent separation.

Compare the results obtained with additive 10 (group 2) with those obtained with additives 17, 18 and 25 (group 5). It is evident that a high concentration of cosolvent does not produce a water wet surface.

Further compare the results obtained with test liquid S (group 5) with those obtained with test liquids G and N (group 4). These results all suggest that a higher concentration of quaternary ammonium compound destabilizes emulsions to permit separation.

From these comparisons, it is concluded that the result obtained with additive 17 is surprising and unexpected Comparing the results produced by test liquids V and T (group 5) with those produced by test liquids D, E, K and L (group 3) suggests the unexpected result that nonionic surfactants overcome the oil wetting tendency of quaternary ammonium compounds.

From the results tabulated in Table 4 it is generally concluded, with respect to a system consisting essentially of fresh water, hydrocarbon oil and esters of modified vegetable oil: that quaternary ammonium componds destabilize emulsions and promote oil wetting of surfaces; that the presence of a sufficient concentration of nonionic surfactant, such as an ethoxylated alkyl phenol, will suppress the oil wetting tendencies of quaternary ammonium componds and will produce emulsions; that ethoxylated alkyl phenols having a low number of ethylene oxide units behave differently from those having a higher number of such units; and that glycols (cosolvents) have little, if any, effect, especially when acting alone.

In addition, it is believed that ethoxylated alkyl phenols having a low number of ethylene oxide units have the ability to penetrate hydrocarbon deposits to a greater extent than do ethoxylated alkyl phenols having a high number of ethylene oxide units.

EXAMPLE 5

A quantity of additive 20, as defined in Table 4-C above, can be placed in a hand applicator, such as a spray bottle, and applied directly on hydrocarbon components, such as oily sludges and hydrocarbon deposits, which adhere to a metal surface to remove the contaminants from the surface. In this regard,. additive 20 can be sprayed on the deposit, permitted to remain in contact with the deposit for a short time, such as a few minutes, and then the treated deposit can be contacted with hot or cold water to flush the deposit and any remaining additive from the surface. The removed deposits and additive form a water external emulsion which can be directed into a container where the emulsion is permitted to separate into an oil layer and a water layer. The oil layer can be recovered after it separates.

The recovered oil layer can be treated to produce an oil product, as is known in the art, and the water can be placed in normal waste-water facilities where it can treated, as is known in the art, for release to the environment.

The surface which was contaminated with the hydrocarbon component will be water-wet.

EXAMPLE 6

Additive 20 can be used to remove thick, solid, adherent, hydrocarbon deposits, such as asphalt, from a surface. In this regard, additive 20 can be sprayed, poured, spread, or splashed on the deposit to form an accumulation of additive on the asphalt to a depth of about ⅛-inch. After a contact period of about 15 to 30 minutes, during which additive 20 is permitted to penetrate the asphalt, the deposit will soften sufficiently to enable its removal by mechanical action such as by scraping and/or shoveling.

Water can then be used to rinse or flush any remaining deposit and adherent oily film from the surface to thereby produce a cleaned water wet surface.

An aqueous emulsion can form during the rinse step in which case the phase separation, recovery, oil processing and disposal steps described in Example 5 can be employed.

This use of additive 20 obviates the prior art methods of chipping the deposit with a hammer and chisel or the repetitious application of prior art solvents to dissolve the entire amount of deposit.

EXAMPLE 7

Additive 20 can be mixed with water having a temperature of about 160° F. to form a water external emulsion containing in the range of from about 0.5 to about 10, and preferably about 5, percent additive 20 by volume of emulsion. The hot emulsion can be sprayed on a surface covered by dense deposits of hydrocarbon components whereby the deposits can be dissolved and flushed from the surface with a stream of high pressure hot water. This method is especially useful in locations where use of chemicals is desired to be minimized and/or where the deposits to be contacted are on walls, ceilings, or elevated areas.

It is noted that the hot water can be in the liquid or vapor phase and the deposits treated can adhere to either internal or external surfaces.

The emulsion formed can be disposed of as described in Example 5.

EXAMPLE 8

An aqueous external emulsion comprised of 0.5 to 10, and preferably about 5, percent additive 20 by volume of emulsion can be prepared, then heated to a temperature of about 160° F. and then introduced into an empty vessel, such as a metal oil storage tank or a metal pipe line, whose internal surface is coated with deposits of dense hydrocarbon components. The heated emulsion is circulated through the vessel to dissolve the heavy deposits and to transport the dissolved deposits to an appropriate storage vessel for separation and further handling as described in Example 5.

The vessel can be all metal, plastic lined or fiberglass.

EXAMPLE 9

A refinery process vessel, and lines associated therewith, whose interior surfaces are coated with hydrocarbon components can be cleaned by first performing a process referred to as "de-oiling" and, thereafter, performing the process described in Example 8.

The de-oiling method is comprised of terminating the flow of process fluid within the vessel and lines, isolating the vessel and lines from adjacent vessels and equipment, adding to any process fluid remaining in the vessel and lines a light oil, such as diesel or light gas oil, containing 1 to 10 percent of any of additives 2–25 (as defined in Table 4) by volume of light oil, and then circulating the combination of light oil and additive throughout the vessel and lines to thereby dissolve the deposits and dilute process fluid. The additive operates to rapidly reduce the viscosity of the fluids and permit efficient sludge dissolution.

Upon completion of the de-oiling process by draining all liquid from the vessel, a process as described in Example 8 can be performed.

This method of treatment is especially useful in process vessels employed in asphalt refining, heavy lube oil handling and refining, catalytic cracker slurry bottoms, that is, heavy residual such as found in the bottom of vacuum crude units and viscosity breakers, and other such heavy hydrocarbon units.

The cleaning effluent can be processed in the normal operation of recovered refinery oils.

EXAMPLE 10

A quantity of additive 17 or additive 20 can be soaked on a rag or mop and then used to simply wipe hydrocarbon component deposits off II of walkway railings such as those around loading stations for trucks.

EXAMPLE 11

A quantity of additive 20 is placed on a hydrocarbon stain on human skin or leather for a few minutes followed by rubbing the stain in the presence of a small quantity of water to remove the stain from the skin or leather.

EXAMPLE 12

Additive 20 was employed in several different locations in an oil refinery as follows. In one location a light, oily film had coated a concrete pad, walkways, and iron grates. A quantity of additive 20 was poured directly on the concrete pad and spread around on the pad with a broom. After several minutes of spreading, the additive was flushed with warm water from a hose. The oily film was removed from the pad. The broom employed to spread the additive was also oil free.

In another location a concrete floor was covered with deposits of asphalt. The deposits were in the form of large (⅛th to 1 inch in height) droppings of asphalt. A quantity of additive 20 was poured from a 5-gallon can directly on the floor and spread around with a broom. In a few minutes, the asphalt began to slowly dissolve as evidenced by black streams flowing away from each asphalt deposit. A stream of cold water from a garden hose was employed to flush dissolved and softened asphalt from floor.

Another location cleaned was the concrete floor in an asphalt pump area. This area had very thick build-ups (up to 12 inches thick in a few spots) of fresh asphalt which feathered down to clean concrete. Additive 20 was poured directly on the asphalt. The additive quickly turned black and subsequent applications of additive 20 produced black liquid which flowed to floor drains. Some of the small spots quickly dissolved away. Water from a garden hose quickly flushed the additive and much of the remaining asphalt away without forming an oily film on the concrete. Some softer asphalt was left in the thicker areas.

It was observed that the surface of the contacted asphalt was much softer than expected. A few large clumps of the softened asphalt were contacted with a scraper and they were easily scraped from the concrete. This was unexpected, since these clumps, prior to being contacted with additive 20, could only be removed by being slowly chipped away. Untreated asphalt in an area adjacent to the treated area could only be removed by chipping.

A rack for loading lube oil and asphalt on trucks was treated with additive 20. In this area new paint on metal rails is covered over in a few days time with grime. The paint was renewed to new condition in a few minutes by placing additive 20 on a shop rag and simply wiping the grimy deposits away. Even fairly thick deposits (¼") were wiped away with surprisingly little effort.

The last area of testing occurred at a lube oil plant which featured high oil spillage around pumps and valves. A large area of fresh spill on a concrete pad was cleaned in a few minutes with additive 20 by just pouring it on the spill, spreading it with a broom, and then flushing the dissoved spill as an oil in water emulsion to the drain with a garden hose.

The emulsion was observed to quickly separate in a few minutes after washing was terminated. In this regard, the puddles of emulsion quickly broke into clean water and floating oil.

Having thus described the invention that which is claimed is:

1. A composition of matter useful to disperse materials comprised of hydrocarbon components, said composition being comprised of a first liquid component and a second liquid component wherein said first liquid component is present in said composition in an amount in the range of from about 70 to about 85 percent by weight of said composition and is the methyl ester of a modified soybean oil made by converting triglycerides in said soybean oil to free acids and said second liquid component is one or more compounds selected from an ethoxylated alkyl phenol and glycols;

wherein said ethoxylated alkyl phenol is present in said composition in an amount in the range of from about 15 to about 20 percent by weight of said composition and is nonyl phenol having 4 ethylene oxide units; and said glycols are present in said composition in an amount in the range of from about 0 to about 10 percent by weight of said composition and are selected from di- and triethylene glycols, di- and tripropylyene glycols, methyl ethers thereof and mixtures thereof.

2. A composition of matter useful to disperse materials comprised of hydrocarbon components, said composition being comprised of a first liquid component and a second liquid component wherein said first liquid component is present in said composition in an amount in the range of from about 80 to about 95 percent by weight of said composition and is the methyl ester of a modified soybean oil made by converting triglycerides in said soybean oil to free acids and said second liquid component is selected from a fatty acid heterocyclic quaternary ammonium compound and glycols;

wherein said fatty acid heterocyclic quaternary ammonium compound is 2-isostearyl 1-hydroxyethyl 1-ethyl imidazolinium ethylsulfate present in said composition in an amount in the range of from about 3 to about 5 percent by weight of said composition; and said glycols are present in said composition in an amount in the range of from about 4 to about 6 percent by weight of said composition and are selected from dipropylene glycol, tripropylene glycol methyl ether and mixtures thereof.

3. A composition of matter useful to disperse materials comprised of hydrocarbon components, said composition being comprised of a first liquid component and a second liquid component wherein said first liquid component is present in said composition in an amount in the range of from about 50 to about 80 percent by weight of said composition and is the methyl ester of a modified soybean oil made by converting triglycerides in said soybean oil to free acids and said second liquid component is selected from an ethoxylated alkyl phenol, glycols, a fatty acid aliphatic quaternary ammonium compound and an amine oxide;

wherein said glycols are selected from dipropylene glycol, tripropylene glycol methyl ether and mixtures thereof present in said composition in an amount in the range of from about 1 to about 15 percent by weight of said composition;

said ethoxylated alkyl phenol is nonyl phenol having 4 to 10 ethylene oxide units, said phenol being present in said composition in an amount in the range of from about 10 to about 30 percent by weight of said composition;

said fatty acid aliphatic quaternary ammonium compound is selected from bis-hydroxyethyl dihydroxypropyl stearaminium chloride, dihydroxypropyl polyethoxy linolenaminium chloride and mixtures thereof present in said composition in an amount in the range of from about 1 to about 5 percent by weight of said composition; and said amine oxide is selected from lauryldimethylamine oxide, bis-(2-hydroxyethyl) isodecyloxypropylamine oxide and mixtures thereof present in said composition in an amount in the range of from about 0 to about 15 percent by weight of said composition.

* * * * *